United States Patent [19]

Step

[11] 4,003,239

[45] Jan. 18, 1977

[54] STRUCTURE FOR ACCOMMODATING REALIGNMENT OF DEFORMED VEHICLES

[76] Inventor: Frank Step, 4410 N. Highway Drive, Tucson, Ariz. 85705

[22] Filed: June 30, 1975

[21] Appl. No.: 591,607

Related U.S. Application Data

[63] Continuation-in-part of Ser. No. 493,171, July 30, 1974.

[52] U.S. Cl. ..... 72/457; 72/705

[51] Int. Cl.[2] ..... B21D 1/14

[58] Field of Search ..... 72/705, 457

[56] References Cited

UNITED STATES PATENTS

| | | | |
|---|---|---|---|
| 1,773,187 | 8/1930 | Johnson | 72/705 X |
| 2,140,686 | 12/1938 | Bennett | 72/705 X |
| 2,559,250 | 7/1951 | Jackson | 72/705 X |
| 2,705,040 | 3/1955 | Howick | 72/705 X |
| 3,214,959 | 11/1965 | Bowden | 72/705 X |
| 3,269,169 | 8/1966 | Latuff et al. | 72/705 X |
| 3,377,834 | 4/1968 | Latuff et al. | 72/705 X |
| 3,888,100 | 6/1975 | Chisum | 72/705 X |

*Primary Examiner*—C.W. Lanham
*Assistant Examiner*—D. M. Gurley
*Attorney, Agent, or Firm*—Cahill, Sutton & Thomas

[57] ABSTRACT

An integrated structure is disclosed for completely enveloping vehicles having a damaged and/or misaligned chassis or frame, which structure serves en masse as an anchor point for hydraulic jacks and other tools used in straightening the chassis or frame.

2 Claims, 2 Drawing Figures

STRUCTURE FOR ACCOMMODATING REALIGNMENT OF DEFORMED VEHICLES

The present application is a continuation-in-part application of an application entitled "DEVICE FOR CORRECTION OF DEFORMED VEHICLES AND MACHINERY", filed July 30, 1974, assigned Ser. No. 493,171, and describing an invention conceived and reduced to practice by the present inventor.

The present invention relates to vehicular chassis and frame straightening structures and, more particularly, to unitary structures which completely envelope a deformed vehicle and serve in totality as the anchor point for chassis and frame straightening tools.

Whenever a vehicle becomes involved in an accident, the chassis or frame almost always becomes misaligned to some degree. For most minor accidents, such misalignment is essentially inconsequential with respect to the normal purposes of the vehicle; therefore, little, if any, corrective action is usually taken. Where, however, the misalignment affects the operation or safety of the vehicle, corrective action must be taken before the vehicle may be used.

A time honored method for straightening deformed chassis or frame members and which provides moderately successful results in some cases, is that of using the chassis or frame itself as an anchor point in applying a force to a deformed member thereof. This method is used by most garages which have limited facilities.

Better results are obtained by employing an anchor point positionally displaced from the vehicle and applying a pulling force upon the deformed member from the anchor point. These anchor points may be lateral, beneath or above the vehicle, as illustrated in U.S. Pat. No. 3,206,966. A yet better result is usually obtained if the vehicle is positioned within a structure such that a plurality of horizontally and/or vertically oriented forces can be applied simultaneously to several chassis or frame members of the vehicle. U.S. Pat. Nos. 1,251,015, 1,773,187, 2,442,939, 2,559,250, 3,214,959, 3,269,169 and 3,377,834 are representative of such structures. Sometimes satisfactory or adequate results are obtained wherein the vehicle is attached to a rail or foundation within lateral and overhead superstructure. Hydraulic or mechanical devices capable of exerting forces in tension or compression interconnect the damaged element with the superstructure. The force exerted upon the damaged element would, but for the vehicle/rail attachment point, displace the vehicle. The force exerted causes, to a large degree, bending or twisting of the damaged element as intended, but some of the force may be absorbed by the vehicle at its point of attachment and cause unwanted deformation to proximate members of the vehicle. Structures of this type are described in U.S. Pat. No. 2,705,040 and German Pat. No. 1,124,906.

A common thread runs through each of the above discussed prior art structures employed in realigning or straightening vehicle chassis and/or frames. That is, the applied corrective force acting upon an element of the vehicle is translated through the vehicle to one or more anchor points to which the vehicle is secured to retain it in place. None of the prior art teach or suggest structure disposed intermediate the anchor point of the vehicle and the point from which the force is applied to prevent and preclude variation in distance therebetween. This defect is of little concern when a single force is applied as any change in displacement can be accommodated by increasing the applied force. Similarly, the defect is of little concern wherein two essentially oppositely oriented forces are applied to the vehicle as the two forces tend to cancel each other out and produce little, if any, resulting repositioning of the vehicle itself; moreover, should the points from which these forces extend be displaced from one another, such displacement is accommodatable by adjusting the applied forces.

It has been learned that the most efficient and accurate manner of straightening misaligned vehicle chassis/frame members, is by simultaneously applying a plurality of forces to the affected areas of the chassis/-frame. To do so accurately, it is mandatory that the point from which the forces are applied be essentially immobile with respect to one another. Otherwise, the application of one force may tend to reorient or modify the degree of effectiveness of the other applied forces.

It is therefore a primary object of the present invention to provide an interconnected unitary structure which completely surrounds a vehicle having a deformed chassis/frame.

Another object of the present invention is to provide a structure for receiving a vehicle having a deformed chassis/frame, which structure serves en masse as an immobile anchor point for attaching chassis/frame alignment tools, regardless of the point of attachment of the tools to the structure.

Yet another object of the present invention is to provide a superstructure lodged within a reinforced concrete foundation to inhibit independent movement of any member of the superstructure member and to add mass to the superstructure.

A further object of the present invention is to provide a superstructure defining a plurality of bays for receiving vehicles having misaligned chassis/frame members and set in a common foundation such that the superstructure and foundation serve en toto as an anchor point for chassis/frame member realigning tools, regardless of the location of the anchor point.

A yet further object of the present invention is to provide vehicle support members disposed within and interconnected to a structure circumscribing a vehicle having deformed chassis/frame members, which supports position the vehicle above the foundation to accommodate the attachment of alignment tools intermediate the vehicle and the superstructure in any direction from the vehicle.

A still further object of the present invention is to provide an interconnected structure having a vehicle receiving track extending therethrough for receiving vehicles having damaged chassis/frame members at one side of the superstructure and discharging the vehicles through the opposite side of the superstructure.

These and other objects of the present invention will become apparent to those skilled in the art as the description thereof proceeds.

The present invention may be described with greater specificity and clarity with reference to the following figures, in which.

To realign the chassis or frame members of a vehicle which has been deformed, it is generally necessary to pull or push upon the deformed members to realign them. Usually, hydraulically operated plungers or mechanically driven arms are attached to an anchor point and brought to bear upon the member to be aligned. In many cases, however, a plurality of such devices are best employed simultaneously to act upon different members and from different directions. In such instances, the anchor points must be locatable anywhere along the sides, top, bottom, front and rear of the vehicle.

Figure 1:
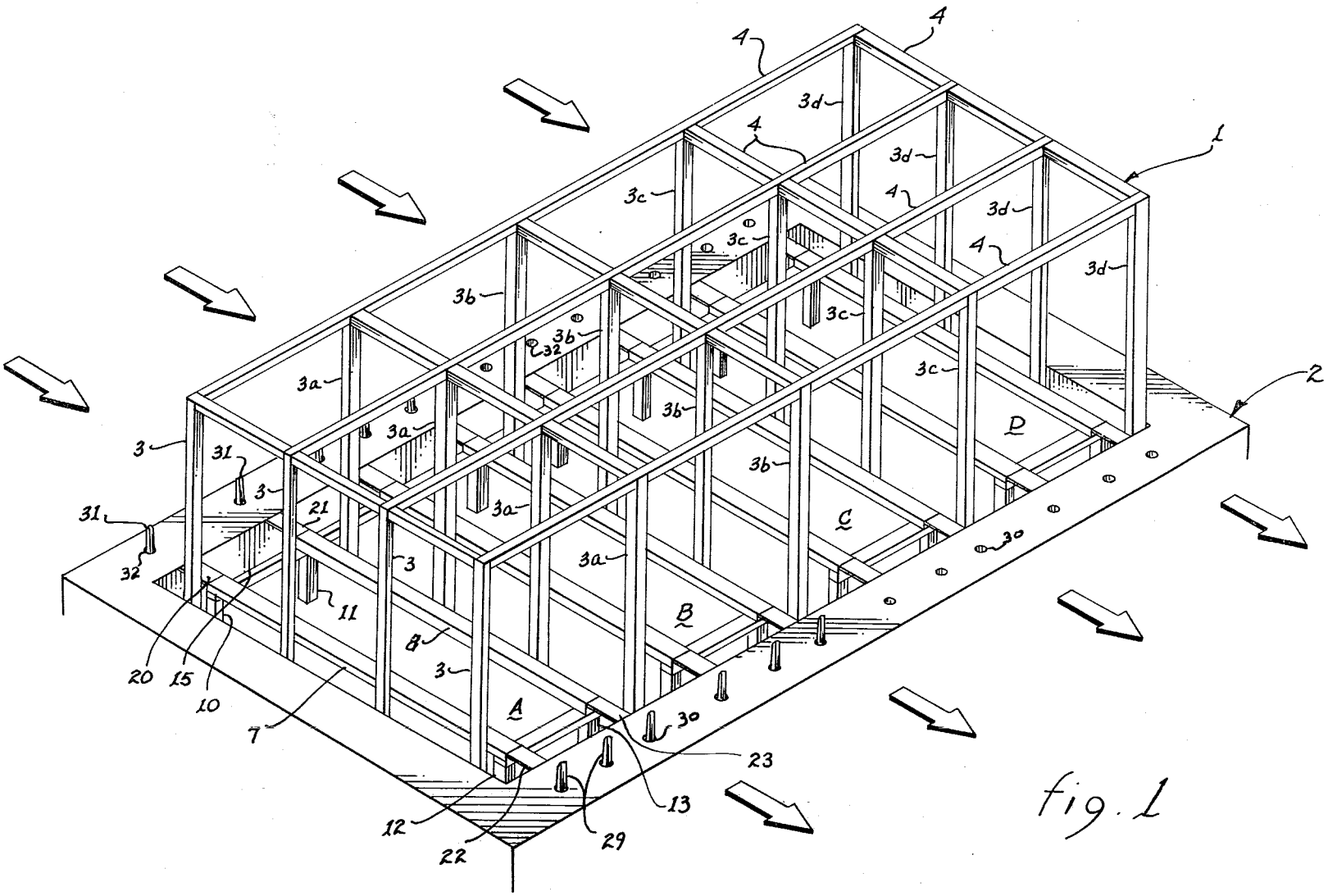
FIG. 1 is a perspective view of the present invention and illustrating a superstructure having a plurality of adjacent bays extending therethrough.

Referring to FIG. 1, there is illustrated a structure which affords such a wide selection of anchor points. Moreover, the illustrated structure is formed of a plurality of interconnected elements to translate any forces exerted upon any given anchor point throughout the structure and providing, at the given anchor point, the stability available from the mass of the whole structure. More particularly, the structure is formed by a superstructure 1, extending upwardly from a steel reinforced concrete foundation 2. It is to be understood that the elements of the superstructure lodged within the foundation are interconnected to one another to aid and ensure complete translation throughout the foundation of any forces imposed upon the structure. A plurality of posts 3 extend upwardly from foundation 2 in general alignment with one another and define a lateral side of bay A; a similar plurality of posts 3*a* extend upwardly from foundation 2 and define the other lateral side of bay A; posts 3*a* and posts 3*b* define the lateral side of bay B; posts 3*b* and posts 3*c* define the lateral sides of bay C and, posts 3*c* and posts 3*d* define the lateral sides of bay D. A plurality of beams rectilinearly interconnect the upper ends of posts 3, 3*a*, 3*b*, 3*c* and 3*d* and define the roofs for bays A, B, C and D.

Further details of the structure within each of the bays will be described with joint reference to FIGS. 1 and 2. A pair of horizontally oriented tracks 7 and 8 are disposed within each of bays A, B, C and D. These tracks are supported above floor 9 of the foundation 2 by pairs of pillars 9, 10 and 11, 12 extending upwardly from within the foundation. Although not illustrated, the pillars are interconnected with part of the superstructure within the foundation. To further aid in establishing essentially complete rigidity of tracks 7 and 8, bars 15 and 16 interconnect the upper ends of pillars 10, 11 and 12, 13, respectively. The tracks and their supporting elements within bays B, C and D are essentially repetitive to those of bay A.

Figure 2:
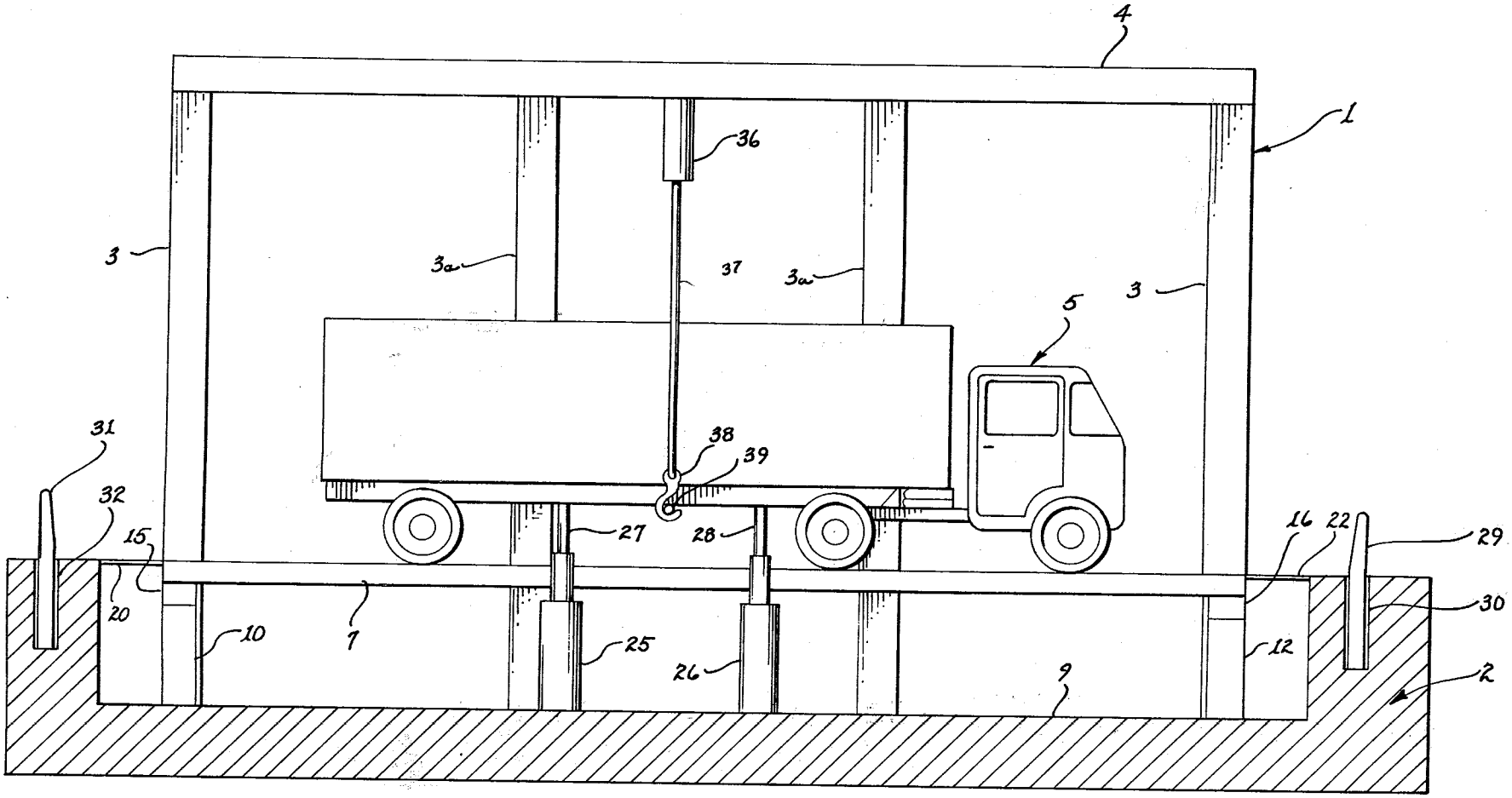
FIG. 2 is a side view of the present invention illustrating a vehicle supported within one of the bays shown in FIG. 1.

It may be noted from FIG. 2, that tracks 7 and 8 are of a length less than the width of floor 9 resulting in a gap intermediate the ends of the tracks and the adjacent upwardly extending wall 14 of the foundation. This gap is purposely maintained to permit workmen complete access about track 7 and 8. Moreover, the gaps accommodate what might otherwise present a physical restriction or constraint in applying a force to the vehicle to be aligned.

To accommodate the placing of a vehicle upon tracks 7 and 8, a plurality of detachable piers 20, 21, 22 and 23 are disposed intermediate to and supported by the respective ends of tracks 7 and 8 and surface 6 of wall 14.

Superstructure 1, through its posts and beams, affords a plurality of selectable anchor points for applying a generally laterally or vertically oriented force to a vehicle positioned within the structure. To apply a force upwardly upon the vehicle from beneath the vehicle, mechanical or hydraulic jacks 25 and 26 are mounted upon floor 9 such that their plungers 27 and 28, respectively, are positionable to act upon the chassis/frame member to be forced upwardly or constrained from downward movement. A plurality of pulling towers 29 and 31 removably slidably disposed within sleeves 30 and 32, respectively, imbedded in wall 14 of foundation 2. By employing hydraulic or mechanical devices, or even a block and tackle, anchored to the pulling towers, forces can be applied in the fore and/or aft direction of the vehicle. Although not illustrated, sleeves 30 and 32 are mechanically interconnected to the superstructure extending through foundation 2 in order to ensure that there will be no relative movement between the sleeves and the other elements of the superstructure.

For illustrative purposes, a selectively contractable mechanism 36 is attached to and extends downwardly from beam 4. A cable 37 extends from the actuating element of mechanism 36 and is attached by a hook 38 to a vehicle 5 at point 39. Thereby, an upward force can be applied to point 39 at one side of the vehicle while other upward forces are applied by plungers 27 and 28 of jacks 25 and 26, respectively, the combination of forces producing an intended bending or other corrective action to a predetermined part of the vehicle.

In operation, a misaligned or deformed vehicle is brought into a bay, such as bay A, by pulling the vehicle with a tow truck or the like. First, of course, pulling towers 31 and 29 must be removed from within their respective sleeves and piers 21–23 are positioned at the respective ends of tracks 7 and 8. The tow truck, when used, drives through superstructure 1 in the direction indicated by the arrows until the deformed vehicle becomes positioned totally within the superstructure. At that time, the tow truck is disengaged from the deformed vehicle and is free to depart in the direction indicated by the arrows.

To work on the deformed vehicle, piers 20–23 are removed to permit workmen complete access about tracks 7 and 8. Pulling towers 29 and 31 are reinstalled within sleeves 30 and 32, respectively, if needed. Once the type and nature of misalignment of deformity has been carefully analyzed, a plurality of hydraulic or mechanical tension or compression inducing mechanisms are attached intermediate selected points of the vehicle and the superstructure and pulling towers. Actuation of these mechanisms necessarily establishes substantial forces upon the foundation via the posts and beams of the superstructure, the pulling towers and the floor mounted jacks.

Because of the mechanically interconnected elements of the structure of the present invention, a completely integrated unit is formed thereby. Thus, the forces exerted upon any section of the structure are translated throughout the structure and resisted by the mass of the structure as a whole. Thereby, any relative displacement between any two or more anchor points is essentially precluded. Such lack of displacement between anchor points permits careful and accurate predetermination of the magnitude and angular orientation of all forces to be applied. Hence, a plurality of forces can be applied simultaneously to act in concert with one another to correct the deformity of a vehicle.

While superstructure 1 is illustrated in FIG. 1 as representing an essentially rectangular envelope, it is to be understood that the bays may be differently sized to be particularly adapted to a certain range of vehicle size. With such selective sizing, the mean spacing intermediate a vehicle and its surrounding superstructure can be maintained within predetermined boundaries. This has particular practical benefits as the force producing mechanisms are restricted in their extension or retraction capability. By maintaining a mean space about a vehicle, through selection of an appropriately sized bay within which to place the vehicle, the same mechanisms can be employed whether work is to be performed upon compact cars or upon heavy duty trucks.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

I claim:

1. An assembly for containing a plurality of vehicles and anchoring vehicle frame and chassis straightening tools, said assembly comprising:

a. a parallel set of a plurality of steel-reinforced cages, platforms and piers disposed within a building;

b. said cages including a superstructure having a plurality of vertically disposed posts and horizontally disposed beams defining a multiple of parallel bays extending to common opposed sides of said superstructure;

c. each bay having an opening at each end thereof for ingress and egress of a vehicle at either of said opposed sides;

d. each juxtaposed pair of bays sharing common vertical posts and horizontal beams;

e. said superstructure being effective to envelop the sides and tops of the vehicles located therein;

f. a parallel pair of said platforms being horizontally disposed within each said bay and extending between each end of the bays;

g. each said pair of platforms being effective to support a vehicle within the respective bay and further effective to allow passage completely through each bay;

h. a pillar located at the ends of each bay to support each platform;

i. a foundation disposed beneath the superstructure for receiving the lower ends of each of said posts and said pillars;

j. a plurality of removable piers wherein each pier extends between the extremity of each platform and said foundation; and k. vehicle frame and chassis straightening tools anchored on said superstructure.

2. The assembly as defined in claim 1 wherein a bar extends across the upper end of pairs of said pillars for supporting the ends of said pair of platforms in each said bay.

* * * * *